US009096813B2

(12) United States Patent
Kawamura et al.

(10) Patent No.: US 9,096,813 B2
(45) Date of Patent: Aug. 4, 2015

(54) GREASE COMPOSITION

(75) Inventors: Yasushi Kawamura, Tokyo (JP); Keiji Tanaka, Kanagawa (JP)

(73) Assignee: Shell Oil Company, Houston, TX (US)

( * ) Notice: Subject to any disclaimer, the term of this patent is extended or adjusted under 35 U.S.C. 154(b) by 591 days.

(21) Appl. No.: 13/121,259

(22) PCT Filed: Sep. 29, 2009

(86) PCT No.: PCT/EP2009/062616
§ 371 (c)(1),
(2), (4) Date: Apr. 21, 2011

(87) PCT Pub. No.: WO2010/037746
PCT Pub. Date: Apr. 8, 2010

(65) Prior Publication Data

US 2011/0195880 A1 Aug. 11, 2011

(30) Foreign Application Priority Data

Sep. 30, 2008 (JP) ..... 2008-253032
Sep. 30, 2008 (JP) ..... 2008-253033

(51) Int. Cl.
*C10L 1/22* (2006.01)
*C10M 169/00* (2006.01)

(52) U.S. Cl.
CPC ..... *C10M 169/00* (2013.01); *C10M 2201/0626* (2013.01); *C10M 2201/1036* (2013.01); *C10M 2203/1006* (2013.01); *C10M 2205/0285* (2013.01); *C10M 2207/122* (2013.01); *C10M 2207/126* (2013.01); *C10M 2207/1285* (2013.01); *C10M 2215/04* (2013.01); *C10M 2215/1026* (2013.01); *C10M 2215/121* (2013.01); *C10M 2217/0456* (2013.01); *C10N 2230/06* (2013.01); *C10N 2250/10* (2013.01)

(58) Field of Classification Search
CPC ..... C10M 137/04; C10M 129/26
USPC ..... 508/144, 464, 473
See application file for complete search history.

(56) References Cited

U.S. PATENT DOCUMENTS

| | | | | |
|---|---|---|---|---|
| 4,100,083 | A * | 7/1978 | Murphy et al. | 508/496 |
| 2002/0013232 | A1 * | 1/2002 | Kinoshita et al. | 508/364 |

FOREIGN PATENT DOCUMENTS

| | | | |
|---|---|---|---|
| EP | 1416036 | 5/2004 | C10M 169/04 |
| GB | 1518342 | 5/1975 | C23F 11/14 |
| JP | 8209167 | 8/1996 | C10M 129/44 |
| JP | 9194867 | 7/1997 | C10M 143/02 |
| JP | 2001089778 | 4/2001 | C10M 107/38 |
| JP | 200831416 | 2/2008 | C10M 162/02 |
| JP | 2009108263 | 5/2009 | C10M 115/08 |
| JP | 2010024440 | 2/2010 | C10M 101/02 |
| WO | WO2010013708 | 4/2010 | C10M 169/06 |

* cited by examiner

*Primary Examiner* — Prem C Singh
*Assistant Examiner* — Francis C Campanell

(57) ABSTRACT

A grease composition for use in resin lubrication wherein at least one amine salt of an unsaturated or saturated fatty acid is incorporated in a grease base material which includes a base oil and a thickener, preferably wherein at least one fatty acid amine salt of the following general formula (1) is incorporated: $RCOO^-$ $R'NH_3^+$ wherein either (i) R is an unsaturated hydrocarbon group having from 15 to 21 carbon atoms, and R' is a saturated or unsaturated linear or branched hydrocarbon group having from 8 to 22 carbon atoms; or (ii) R is a linear saturated hydrocarbon group having from 5 to 21 carbon atoms, and R' is an unsaturated hydrocarbon group having from 16 to 18 carbon atoms. The grease composition of the present invention improves the lubricity between resin and resin or resin. and another material such as a metal.

6 Claims, No Drawings

GREASE COMPOSITION

PRIORITY CLAIM

The present application claims priority to Japanese Patent Application No. 2008-253032 filed Sep. 30, 2008 and Japanese Patent Application No. 2008-253033 filed Sep. 30, 2008.

TECHNICAL FIELD

This invention relates to a grease composition for use in resin lubrication to be used at lubrication points where resin materials are used and rolling or sliding occurs.

BACKGROUND OF THE INVENTION

In recent years, the use of resins for parts not only in the automobile industry but also in various kinds of industrial machines has become noteworthy, for many reasons such as lighter weights, cost reductions, less friction, or recycling. But many new issues have arisen as the constituent elements of the parts have diversified, and various technical improvements are being undertaken.

For example, there are lubrication points such as the sliding parts of movable elements in electric door mirrors of cars or telescopic steering columns, various sliding parts such as the rack guides of R & P steering, the sliding parts of drive transmission gears, actuators and air cylinders in steering gears, linear guides or ball screw retainers of machine tools or bearing retainers, the sliding parts of crane booms, and also resin gear parts in acoustical equipment such as radio cassette players, video tape recorders and CD players, the resin gear parts in office automation equipment such as printers, photocopiers and fax machines, and the sliding parts of various kinds of electrical switches, which function through contact between materials other than metallic materials such as resin and resin or resin and metal.

In the prior art, in the field of lubrication, because virtually all the constituents of machines have been of metallic materials, there has been a long and broad history of research on friction and wear of pairs of metals such as iron, aluminium, alloys thereof, brass and bronze, and the prior art is replete with profound experience and knowledge.

For example, it is well known that extreme pressure agents and anti-wear agents which contain elements such as phosphorus and sulphur are effective against friction and wear for pairs of metals, and that these additives form a skin by positively giving rise to a chemical reaction with the surface of the metals, thereby exhibiting functions such as reducing friction and wear and preventing seizing. This prior art has been widely applied in engine oils and gear oils as well as in high performance industrial lubricating oils and greases.

However, notwithstanding the fact that the history of lubrication technology for different materials, such as resin pairs or resins and metals, has been short, the use of these has, as mentioned above, been expanding and diversifying in recent years, but the situation at present is such that no art has yet been offered that completely satisfies the various requirements regarding their lubricating greases.

For example, if the techniques using the phosphorus or sulphur based additives which are effective against friction and wear of metal pairs are applied to the lubrication points of, for example, resin pairs or resin and metal, virtually no effect in reducing friction such as is obtained for metal pairs is obtained. On the contrary, cases where the friction and anti-wear performance may deteriorate and the life of the machines parts may be shortened are by no means rare.

This is considered, in the case of resins, to be because, compared with metals, their surface activity is very weak, so that there is virtually no reaction with organic based additives such as phosphorus or sulphur based additives on the sliding surfaces, and given that adsorption is also weak, the effect on friction and wear is poor, and so the action of reducing friction is weak. Also, if they are used in environments where temperatures inevitably rise, the active phosphorus and sulphur in these additives may permeate inside the resin parts, which may give rise to perverse actions such as the occurrence of cracks or brittleness, or even the promotion of friction and wear.

In order to improve the lubrication state between the aforementioned resin pairs or between a resin and a different material such as a metal, a grease for use in resin lubrication has been proposed (Japanese Laid-open Patent H08-209167 (1996)) where an adequate oil film is maintained for lubrication between metal and resin by incorporating a fatty acid containing hydroxyl groups, or a fatty acid ester of a polyhydric alcohol, in a grease in which the main constituents are a thickener and a base oil, and also where the occurrence of torque fluctuations is inhibited. In addition, a technique has been disclosed (Japanese Laid-open Patent 2001-89778) to reduce wear of the resin parts used under rigorous lubrication conditions, and to give excellent anti-wear properties, by incorporating a polytetrafluoroethylene fine powder in a grease. In addition, a technique has been proposed wherein a lubricating grease containing a polyolefin wax of average molecular weight 900 to 10,000 in a grease which contains a base oil and a thickener manifests low friction on resin lubrication areas and contributes to an improvement in the efficiency of parts having resin lubrication areas (Japanese Laid-open Patent H09-194867 (1997)). And a technique has been disclosed which has superior resin wear resistance by virtue of a grease for use with resins containing as the thickening agent a metal soap thickener, a complex metal soap thickener or a polyurea together with a compound having a laminar structure (Japanese Laid-open Patent 2008-31416). Further improvements may be expected.

The present invention is intended to obtain a grease composition for use in resin lubrication such that friction is alleviated and good lubricity is obtained at lubrication points where at least one element of a pair such as resin and resin or resin and a different material such as metal is constituted of a resin material and rolling or sliding occurs.

Having carried out research and investigations on the theory of the surface chemistry of the lubrication behaviour of resins, the inventors have discovered that the very weak electrical forces, occurring on the surfaces of a resin and its opposing member, in cases such as resin and resin or resin and a different material such as a metal, interact with certain kinds of fatty acid amine salts added to greases, and further that these additives exhibit a binding action with the grease, so that it is possible to create a lubricating film more reliably on the surfaces of the resin and the material opposing the resin and thus obtain a reduction in wear and better lubricating qualities. They have thus arrived at this invention.

SUMMARY OF THE INVENTION

According to the present invention there is provided a grease composition for use in resin lubrication wherein at least one amine salt of an unsaturated or saturated fatty acid is incorporated in a grease base material which includes a base oil and a thickener.

This aforementioned unsaturated or saturated fatty acid amine salt is preferably one shown by the following general formula (1).

$$RCOO^{-}\ R'\ NH_3^{+} \quad (1)$$

wherein either (i) R is an unsaturated hydrocarbon group having from 15 to 21 carbon atoms, and R' is a saturated or unsaturated linear or branched hydrocarbon group having from 8 to 22 carbon atoms;

or (ii) R is a linear saturated hydrocarbon group having from 5 to 21 carbon atoms, and R' is an unsaturated hydrocarbon group having from 16 to 18 carbon atoms.

The total amount of unsaturated or saturated fatty acid amine salt included is preferably in the range of from 0.1 to 10% by mass relative to the total amount of the grease composition.

According to this invention it is possible to further alleviate friction and to obtain good lubrication characteristics at lubrication points where there is rolling or sliding between members where one of the opposing sides is constituted by a resinous material, and it is possible to use it widely for grease compositions for use in resin lubrication.

DETAILED DESCRIPTION OF THE INVENTION

The base oil in this invention is one which may ordinarily be used as the base oil of a lubricating oil or as the base oil of a grease, and there are no special restrictions. As examples mention may be made of mineral oils, synthetic oils, animal and plant oils, and mixtures thereof.

In particular it is possible to use, singly or as mixtures, base oils which belong to Group I, Group II, Group III, Group IV and so on of the API (American Petroleum Institute) base oil categories.

Group I base oils include, for example, paraffinic mineral oils obtained by a suitable combination of refining processes such as solvent refining, hydrorefining, and dewaxing in respect of lubricating oil fractions obtained by atmospheric distillation of crude oil.

Group II base oils include, for example, paraffinic mineral oils obtained by a suitable combination of refining processes such as hydrorefining and dewaxing in respect of lubricating oil fractions obtained by atmospheric distillation of crude oil. Group II base oils refined by hydrorefining methods such as the Gulf Company method have a total sulphur content of less than 10 ppm and an aromatic content of not more than 5% and so are suitable for use in this invention.

Group III base oils and Group II+ base oils include paraffinic mineral oils manufactured by a high degree of hydrorefining in respect of lubricating oil fractions obtained by atmospheric distillation of crude oil, base oils refined by the Isodewax process which dewaxes and substitutes the wax produced by the dewaxing process with isoparaffins, and base oils refined by the Mobil wax isomerisation process. These too are suitable for use in this invention.

Specific examples of synthetic oils include polyolefins, polyoxyalkylene glycols such as polyethylene glycol or polypropylene glycol, esters such as di-2-ethylhexyl sebacate or di-2-ethylhexyl adipate, polyol esters such as trimethylolpropane esters or pentaerythritol esters, perfluoroalkyl ethers, silicone oils, polyphenyl ethers, and so on.

The aforementioned polyolefins include polymers of various olefins or hydrides thereof. Any olefin may be used, and as examples mention may be made of ethylene, propylene, butene and α-olefins with five or more carbons. In the manufacture of polyolefins, one of the aforementioned olefins may be used singly or two or more may be used in combination. Particularly suitable are the polyolefins called poly-α-olefins (PAO). These are base oils of Group IV.

GTLs (gas to liquid oils) synthesized by the Fischer-Tropsch method of converting natural gas to liquid fuel have a very low sulphur content and aromatic content compared with mineral oil base oils refined from crude oil and have a very high paraffin constituent ratio, and so have excellent oxidative stability, and because they also have extremely small evaporation losses, they are suitable as base oils for this invention.

Also, as typical examples of animal and plant oils mention may be made of castor oil and rapeseed oil.

The various kinds of oil mentioned above may be used as base oils either alone or as mixtures, but the aforementioned instances are mere examples and the invention is not limited by these.

The thickeners blended in the aforementioned base oil include all thickeners used for lubricating greases, and there are no special restrictions, but they include, for example, lithium soaps, lithium 12 hydroxy soaps, calcium soaps, sodium soaps, barium soaps, barium complex soaps, calcium complex soaps, aluminium complex soaps, lithium complex soaps, bentone, clay, silica, tricalcium phosphate, calcium sulphonate complexes, polyureas, sodium terephthalamate and so on. These thickeners may be used alone or in combinations.

Fatty acid amine salts are added to the aforementioned grease base material which contains the base oil and thickener. These are couplings of amines and fatty acids. Many types of fatty acid amine salts can easily be formed by varying the combinations of the types of fatty acids and the types of amines, and they are much used in the industrial sector, mainly as surfactants and rust inhibitors.

For the amines which are the raw material of the aforementioned unsaturated fatty acid amine salts in this invention it is possible to use monoamines or diamines.

The monoamines are preferably saturated or unsaturated linear or branched primary amines with 8 to 22 carbons, and as examples mention may be made of octylamine (caprylamine), isooctylamine, laurylamine, myristylamine, palmitylamine, stearylamine, isostearylamine, behenylamine, oleylamine, linoleylamine, beef tallow amine, coconut amine, hydrogenated beef tallow amine and soybean amine.

As examples of diamines mention may be made of ethylenediamine, trimethylenediamine (propylendiamine), tetramethylenediamine (butylenediamine), pentamethylenediamine, hexamethylenediamine, 1,7-diaminoheptane, 1,8-diaminooctane, 1,9-diaminononane, 1,10, o-phenylenediamine, m-phenylehediamine and p-phenylenediamine. As example of the salts thereof mention may be made of N-coconut alkyl-1,2-ethylenediamine, N-beef tallow alkyl-1,2-ethylenediamine, N-hardened beef tallow alkyl-1,2-ethylenediamine, N-coconut alkyl-1,3-propylenediamine, N-beef tallow alkyl-1,3-propylenediamine, N-hardened beef tallow alkyl-1,3-propylenediamine, N-coconut alkyl-1,4-butylenediamine, N-beef tallow alkyl-1,4-butylenediamine, and N-hardened beef tallow alkyl-1,4-butylenediamine.

For the primary amines which are the raw material of the aforementioned saturated fatty acid amine salts unsaturated primary amines of 16 to 18 carbons are preferred, and as examples mention may be made of palmitoyl amine, oleylamine and linoleylamine.

A characteristic feature of this invention is that, of these fatty acid amine salts, it is more preferable to use an unsaturated or saturated fatty acid amine salt of the following general formula (1).

$$RCOO^{-}\ R'\ NH_3^{+} \quad (1)$$

wherein either (i) R is an unsaturated hydrocarbon group having from 15 to 21 carbon atoms, and R' is a saturated or unsaturated linear or branched hydrocarbon group having from 8 to 22 carbon atoms.

or (ii) R is a linear saturated hydrocarbon group having from 5 to 21 carbon atoms, and R' is an unsaturated hydrocarbon group having from 16 to 18 carbon atoms.

For the unsaturated fatty acid, unsaturated fatty acids of 16 to 22 carbons are preferred, and as examples mention may be made of palmitoylic acid, oleic acid, vaccenic acid, linolic acid, linolenic acid, elaeostearic acid, eicosadienic acid, eicosatrienic acid, arichidonic acid and erucic acid.

For the saturated fatty acid, linear saturated fatty acids of 6 to 22 carbons are preferred, and as examples mention may be made of caproic acid, caprylic acid, pelargonic acid, capric acid, lauric acid, linderic acid, myristic acid, tsuzuic acid, physetoleic acid, myristoleic acid, pentadecylic acid, palmitic acid, margaric acid, stearic acid, petroselinic acid, elaidic acid, tuberculostearic acid, arachidiinc acid and behenic acid.

The unsaturated and saturated fatty acid amine salts of this invention have strong adsorption onto the friction surfaces between the resin and resin or other material, and the effect of reducing friction between the members is extremely large.

The total content of the one or two or more unsaturated fatty acid amine salts or of the one or two or more saturated fatty acid amine salts is preferably in the range of from about 0.1 to 10%, more preferably from about 1 to 5% by mass, relative to the total amount of the grease composition. If it is less than 0.1% by mass, the electrochemical action on the surface is too small and the effect of reducing the friction coefficient is low. Also, if the unsaturated or saturated fatty acid amine salt is greater than 10% by mass, it is likely that it will become difficult to exhibit the basic performance of the grease composition (for example, viscoelasticity, shear stability and heat resistance) effectively and to maintain a stable state over a long period of time. The cost also increases.

Also, for the additives of the grease composition of this invention, it is possible further to add as appropriate other additives such as anti-oxidants, rust inhibitors, oiliness agents, extreme pressure agents, anti-wear agents, solid lubricants, metal deactivators, polymers and so on.

Examples of anti-oxidants include 2,6-di-t-butyl-4-methylphenol, 2,6-di-t-butylparacresol, p,p'-dioctyldiphenylamine, N-phenyl-α-naphthylamine, and phenothiazines.

Rust inhibitors include paraffin oxide, carboxylic acid metal salts, sulphonic acid metal salts, carboxylic acid esters, sulphonic acid esters, salicylic acid esters, succinic acid esters, sorbitan esters and various amine salts.

Oiliness agents, extreme pressure agents and anti-wear agents include for example sulphurised zinc dialkyldithiophosphates, sulphurised zinc diaryldithiophosphates, sulphurised zinc dialkyldithiocarbamates, sulphurised zinc diaryldithiocarbamates, sulphurised molybdenum dialkyldithiophosphates, sulphurised molybdenum diaryldithiophosphates, sulphurised molybdenum dialkyldithiocarbamates, sulphurised molybdenum diaryldithiocarbamates, organomolybdenum complexes, sulphurised olefins, triphenylphosphates, triphenylphosphorothionates, tricresylphosphates, other phosphate esters, and sulphurised oils and fats.

Solid lubricants include, for example, molybdenum disulphide, graphite, boron nitride, melamine cyanurate, PTFE (polytetrafluoroethylene), tungsten disulphide, mica and graphite fluoride.

Metal deactivators include N,N'-disalicylidene-1,2-diaminopropane, benzotriazoles, benzoimidazoles, benzothiazoles, and thiadiazoles, and so on.

As examples of polymers mention may be made of polybutenes, polyisobutenes, polyisobutylenes, polyisoprenes and polymethacrylates.

The additional additives mentioned above are all given as examples and they are in no way limited to these.

In this invention, it is possible to alleviate friction and obtain good lubricity at lubrication points where rolling or sliding appears between opposing members where one side is constituted of a resinous material. Consequently, it is necessary that one opposing member is a resin, but the member that opposes that resin can be, apart from a resin, iron, copper, aluminium or other metal and alloys thereof, rubbers and glasses, or non-polar materials such as ceramics, and these can be widely used with no special restrictions.

Also, it is possible to use any ordinary plastics or engineering plastics for the aforementioned resin materials, and as examples mention may be made of polyamides, polyacetals, polycarbonates, polyethylene terephthalates, polybutylene terephthalates, polybutylene naphthalates, polyphenylene ethers, polyphenylene sulphides, fluorinated resins, polyacrylates, polyamidimides, polyether imides, polyether ether ketones, polysulphones, polyether sulphones, polyimides, polystyrenes, polyethylenes, polypropylenes, phenol resins, AS resins, ABS resins, AES resins, AAS resins, ACS resins, MBS resins, polyvinyl chloride resins, epoxy resins, diallyl phthalate resins, polyester resins, methacryl resins, and ABS/polycarbonate alloys, but they are not limited to these.

EXAMPLES

The present invention is further explained in detail below by means of examples and comparative examples, but the invention is in no way limited by these examples.

The following materials were prepared to produce the examples and comparative examples.

1. Base oil A: a mineral oil with kinetic viscosity at 40° C. of 101.1 $mm^2/s$.
2. Base oil B: a poly-α-olefin oil with kinetic viscosity at 40° C. of 31.2 $mm^2/s$.
3. Base oil C: a highly refined oil with kinetic viscosity at 40° C. of 47.08 $mm^2/s$, viscosity index of 146, % CA of less than 1, % CN of 11.9, and % CP of not less than 85.
4. Thickener A: a diurea obtained by a synthesis reaction of 2 mol of octylamine and 1 mol of MDI (4,4'-diphenylmethane diisocyanate) in the base oil.
5. Thickener B: lithium 12 hydroxystearate soap obtained by reaction of 12-hydroxystearic acid and lithium hydroxide in the base oil.
6. Thickener C: obtained by gelation after swelling an hydroxyapatite/tricalcium phosphate composite as expressed by $[Ca_3(PO_4)_2]_3.Ca(OH)_2$ with an organic solvent.
7. Thickener D: bentonite obtained by gelation after swelling bentonite with an organic solvent in the base oil.
8. Thickener E: sodium terephthalamate obtained by reaction of methyl N-octadecyl terephthalate and sodium hydroxide in the base oil.
9. Grade 1 or higher reagents were used for the amines (other than oleylamine) and fatty acids which were the raw materials of the fatty acid amine salts.
10. In the case of oleylamine among the amines, the raw material used was an ordinary industrial material where the 18-carbon unsaturated component (the oleyl component) was at least 75% and the 16-carbon unsaturated component (palmitoyl component) was at least 5%.

The greases were prepared using the base oils and thickeners in the proportions shown for Examples 1 to 48 in Tables 1 to 9, and the grease compositions were obtained by adding the various fatty acid amine salts.

In specific detail, for the greases using thickener A (a urea) in Examples 1 to 13 and Examples 26 to 33, the base oil, the raw material of thickener A and the various amines and fatty acids which are the additives were first weighed out in the proportions and molar ratios shown in Tables 1 to 3 (for Examples 1 to 13) and Tables 6 and 7 (for Examples 26 to 33) so that the total amount of the grease composition would be 1000 g. Then, a portion of the base oil and the MDI (4,4'-diphenylmethane diisocyanate), being the raw material of thickener A, were pasted into a kettle of capacity 3 kg specially used for preparation of greases. While heating and stirring to raise the temperature to 60° C., a reaction was effected by pasting in the octylamine premixed and dissolved in the rest of the base oil. Once the temperature had further been raised to 180° C., cooling was effected at a fixed rate, and a base grease comprising thickener A was obtained. A fatty acid amine salt in which an amine and a fatty acid as aforementioned had previously been dissolved and coupled in the base oil in a separate vessel was pasted into the kettle and, after a homogeniser treatment, the grease compositions for use in resin lubrication for each of the examples were obtained.

For the grease compositions using thickener B (a lithium soap) in Examples 14 and 15 and in Examples 34 to 37, the base oil, the raw material of thickener B and the various amines and fatty acids which are the additives were first weighed out in the proportions and molar ratios shown in Table 3 (for Examples 14 and 15) and Table 7 (for Examples 34 to 37) so that the total amount of the composition would be 1000 g. Then, the base oil and the 12-hydroxystearic acid and lithium hydroxide were pasted into a kettle of capacity 3 kg specially used for preparation of greases, which was sealed, and, while heating and stirring, a saponification reaction was effected. Once the temperature had been raised to approximately 150° C. at a pressure of 0.35 MPa, moisture was gradually released. After further heating to 215° C., the contents had been dissolved, and cooling was effected at a fixed rate. A base grease comprising thickener B in which soap strands had been developed was obtained. Next, a fatty acid amine salt in which an amine and a fatty acid as aforementioned had previously been dissolved and coupled in the base oil in a separate vessel was pasted into the kettle and, after a homogenises treatment, the grease compositions for use in resin lubrication for each of the examples were obtained.

For the grease compositions using thickener C (tricalcium phosphate) in Examples 16 and 17 and in Examples 38 and 39, the base oil, the raw material of thickener C and the various amines and fatty acids which are the additives were first weighed out in the proportions and molar ratios shown in Table 4 (for Examples 16 and 17) and Table 8 (for Examples 38 and 39) so that the total amount of the composition would be 1000 g. Then, the base oil, the tricalcium phosphate and an organic solvent to promote gelation were pasted into a kettle of capacity 3 kg specially used for preparation of greases. While heating and stirring to raise the temperature gradually to 150° C., as the organic solvent became volatile it was allowed to diffuse homogeneously and effect swelling. Cooling was then effected at a fixed rate and a base grease comprising thickener C was obtained. Then a fatty acid amine salt in which an amine and a fatty acid as aforementioned had previously been dissolved and coupled in the base oil in a separate vessel was pasted into the kettle and, after a homogeniser treatment, the grease compositions for use in resin lubrication for each of the examples were obtained.

For the grease compositions using thickener D (bentonite) in Examples 20 and 23 and in Examples 42, 43 and 46, which was used as a mixture with other thickeners, the base oil and the raw material of thickener D were first weighed out in the proportions shown in Tables 4 and 5 (for Examples 20 and 23) and in Tables 8 and 9 (for Examples 42, 43 and 46) so that the total amount of the composition would be 1000 g. Then, the base oil and the bentonite, and an organic solvent to promote gelation, were pasted into a kettle of capacity 3 kg specially used for preparation of greases. While heating and stirring to raise the temperature gradually to 150° C., as the organic solvent became volatile it was allowed to diffuse homogeneously to effect swelling. Then cooling was effected at a fixed rate and a base grease comprising thickener D was obtained.

Next, base greases comprising thickener A for Example 20 and Examples 42 and 43 and thickener C for Example 23 and Example 46 were prepared in separate kettles in the proportions shown in Tables 4 and 8 (for Examples 20, 42 and 43) and in Tables 5 and 9 (for Examples 23 and 46). They were then mixed with a base grease comprising thickener D at room temperature in the proportions shown in the tables. Finally, a fatty acid amine salt in which an amine and a fatty acid as aforementioned had previously been dissolved and coupled in the base oil in a separate vessel in the proportions and molar ratios shown for each example was pasted into, the kettle and, after a homogeniser treatment, the grease compositions for use in resin lubrication for Examples 20 and 23 and Examples 42, 43 and 46 were obtained.

For the grease using thickener E (sodium terephthalamate) in Example 25 and in Example 48, the base oil, the raw material of thickener E and the amine and fatty acids which are the additives were first weighed out in the proportions and molar ratios shown in Table 5 (in the case of Example 25) and Table 9 (in the case of Example 48) so that the total amount of the grease composition would be 1000 g. Then, a portion of the base oil and the methyl N-octadecylterephthalate which was the raw material for thickener D were pasted into a kettle of capacity 3 kg specially used for preparation of greases. While heating and stirring, at a temperature of 90° C. a sodium hydroxide suspension which had previously been stirred and dispersed in water was folded into the kettle, and a reaction was effected while heating and stirring to raise the temperature gradually to 170° C. Then cooling was effected at a fixed rate, and a base grease comprising thickener E was obtained. Then a fatty acid amine salt in which an amine and a fatty acid as aforementioned had previously been dissolved and coupled in the base oil in a separate vessel was pasted into the kettle and, after a homogeniser treatment, the grease composition for use in resin lubrication for the example was obtained.

Grease compositions for use in resin lubrication using a mixture of thickeners according to Examples 18, 19, 21, 22, 24, 40, 41, 44, 45 and 47 were obtained in like manner as for the greases of Examples 20, 23, 42, 43 and 46 where the base greases were obtained by using the method of grease preparation mentioned above.

The grease compositions for Comparative Examples 1 to 18 were produced by weighing out the raw materials in the proportions shown in Tables 10 to 12 and following the method of manufacture specified for the aforementioned examples.

The following measurements and experiments were carried out in order to compare the characteristics and performance of the examples and comparative examples.

1. Penetration: Measured in accordance with JIS K2220-7.
2. Dropping point: Measured in accordance with JIS K2220-8.
3. Kinetic viscosity of base oil: Measured in accordance with JIS K2283.
4. Friction tests: Bowden type friction tests were carried out. In other words, the friction coefficient between a resin (test material 1b) and a paired material other than a resin (test material 1a) was measured under the following test conditions using a Bowden friction test rig.

(1) Test material 1a: Material—steel S45C and copper alloy ALBC2.

Dimensions—pin shape of outside diameter 5.0 mm and length 24 mm, the pin tip being a semi-spheroid of r=2.5 mm, and the contact surface was machined to a flat area of approximately 1.0 mm diameter.

(2) Test material 1b: Material—polyamide resin (66 Nylon/Amilan made by Toray Ltd.) and polyacetal resin (Delrin 500P made by Dupont Ltd.)

Dimensions—plate of length 200 mm, width 52 mm.

(3) Temperature: 25° C.

(4) Sliding rate: 1.0 mm/s (5) Load: 870 g (6) Surface pressure of contact surfaces: 10 MPa A Bowden friction test was carried out on all the examples and on all the comparative examples for a polyamide resin and steel pairing, and tests were carried out selectively for a polyacetal resin and copper alloy pairing.

Test Results

These are as shown in Tables 1 to 12.

Discussion

The grease compositions of Examples 1 to 25 (according to the present invention) all exhibited a semi-solid grease state, and the penetration exhibited values of moderate hardness in the range 268 to 307, while the dropping point was also good at not less than 180° C. Further, the friction coefficients between polyamide resin and steel in the Bowden friction tests were 0.044 to 0.059, and the friction coefficients between polyacetal resin and copper alloy were all low at 0.042 to 0.056. The grease compositions of Examples 26 to 48 (according to the present invention) all exhibited a semi-solid grease state, and the penetration exhibited values of moderate hardness in the range 270 to 305, while the dropping point was also good at not less than 178° C. Further, the friction coefficients between polyamide resin and steel in the Bowden friction tests were 0.048 to 0.065, and the friction coefficients between polyacetal resin and copper alloy were all low at 0.049 to 0.062. It is evident that good lubrication performance is thus demonstrated between resins and materials other than resins such as copper alloy and steel.

In contrast, the grease compositions of Comparative Examples 1 to 18 all exhibited a semi-solid grease state, and the penetration exhibited values of moderate hardness in the range 266 to 302, while the dropping point was also good at not less than 175° C., but the friction coefficients between polyamide resin and steel in the Bowden friction tests were 0.081 to 0.127, and the friction coefficients between polyacetal resin and copper alloy were all also high at 0.088 to 0.121. It is evident that they were all inferior to the examples according to the present invention as regards the state of lubrication between resins and materials other than resins such as copper alloy and steel, and that no effect of improving the lubrication performance was obtained.

On the basis of these results it can be seen that the grease composition of the invention for use in resin lubrication exhibits good lubrication performance.

TABLE 1

| | Example | | | | |
|---|---|---|---|---|---|
| | 1 | 2 | 3 | 4 | 5 |
| (1) Base oil (mass %) | | | | | |
| Lubricating oil A | 88.0 | 88.0 | 89.0 | 44.5 | — |
| Lubricating oil B | — | — | — | 44.5 | 89.0 |
| Lubricating oil C | — | — | — | — | — |
| (2) Thickener (mass %) | | | | | |
| Thickener A | 10.0 | 10.0 | 10.0 | 10.0 | 10.0 |
| Thickener B | — | — | — | — | — |
| Thickener C | — | — | — | — | — |
| Thickener D | — | — | — | — | — |
| Thickener E | — | — | — | — | — |
| (3) Amount of fatty acid amine salt added (mass %) | 2.0 | 2.0 | 1.0 | 1.0 | 1.0 |
| Primary amine (molar ratio) | | | | | |
| Octylamine C8 | 1 | 1 | — | — | — |
| Laurylamine C12 | — | — | 1 | — | — |
| Myristylamine C14 | — | — | — | 1 | — |
| Stearylamine C18 | — | — | — | — | 1 |
| Behenylamine C22 | — | — | — | — | — |
| Oleylamine C18'-16' | — | — | — | — | — |
| 2-ethylhexylamine iso-C8 | — | — | — | — | — |
| Fatty acid (molar ratio) | | | | | |
| Caproic acid C6 | — | — | — | — | — |
| Caprylic acid C8 | — | — | — | — | — |
| Lauric acid C12 | — | — | — | — | — |
| Myristic acid C14 | — | — | — | — | — |
| Palmitic acid C16 | — | — | — | — | — |
| Stearic acid C18 | — | — | — | — | — |
| 12-Hydroxystearic acid C18 | — | — | — | — | — |

TABLE 1-continued

| | Example | | | | |
|---|---|---|---|---|---|
| | 1 | 2 | 3 | 4 | 5 |
| Behenic acid C22 | — | — | — | — | — |
| 2-Ethylhexanoic acid iso-C8 | — | — | — | — | — |
| Palmitoylic acid C16' | 1 | — | — | — | — |
| Oleic acid C18' | — | 1 | 1 | 1 | 1 |
| Linolic acid C18" | — | — | — | — | — |
| Erucic acid C22' | — | — | — | — | — |
| Total (1) + (2) + (3) | 100.0 | 100.0 | 100.0 | 100.0 | 100.0 |
| Penetration (×0.1 mm) | 276 | 274 | 273 | 276 | 277 |
| Dropping point (° C.) | 261 | 262 | 255 | 257 | 261 |
| Kinematic viscosity of base oil (40° C., $mm^2$/sec) | 101.1 | 101.1 | 101.1 | 53.51 | 31.24 |
| Friction tests (friction coefficient) | | | | | |
| (1) Polyamide resin-steel | 0.058 | 0.047 | 0.051 | 0.047 | 0.048 |
| (2) Polyacetal resin-copper alloy | 0.055 | 0.045 | 0.052 | — | 0.046 |

TABLE 2

| | Example | | | | |
|---|---|---|---|---|---|
| | 6 | 7 | 8 | 9 | 10 |
| (1) Base oil (mass %) | | | | | |
| Lubricating oil A | 44.5 | 44.0 | — | 89.0 | 89.0 |
| Lubricating oil B | — | 22.5 | — | — | — |
| Lubricating oil C | 44.5 | 22.5 | 89.0 | — | — |
| (2) Thickener (mass %) | | | | | |
| Thickener A | 10.0 | 10.0 | 10.0 | 10.0 | 10.0 |
| Thickener B | — | — | — | — | — |
| Thickener C | — | — | — | — | — |
| Thickener D | — | — | — | — | — |
| Thickener E | — | — | — | — | — |
| (3) Amount of fatty acid amine salt added (mass %) | 1.0 | 1.0 | 1.0 | 1.0 | 1.0 |
| Primary amine (molar ratio) | | | | | |
| Octylamine C8 | — | — | — | 1 | — |
| Laurylamine C12 | — | — | — | — | — |
| Myristylamine C14 | — | — | — | — | — |
| Stearylamine C18 | — | — | — | — | 1 |
| Behenylamine C22 | 1 | — | — | — | — |
| Oleylamine C18'-16' | — | 1 | — | — | — |
| 2-ethylhexylamine iso-C8 | — | — | 1 | — | — |
| Fatty acid (molar ratio) | | | | | |
| Caproic acid C6 | — | — | — | — | — |
| Caprylic acid C8 | — | — | — | — | — |
| Lauric acid C12 | — | — | — | — | — |
| Myristic acid C14 | — | — | — | — | — |
| Palmitic acid C16 | — | — | — | — | — |
| Stearic acid C18 | — | — | — | — | — |
| 12-Hydroxystearic acid C18 | — | — | — | — | — |
| Behenic acid C22 | — | — | — | — | — |
| 2-Ethylhexanoic acid iso-C8 | — | — | — | — | — |
| Palmitoylic acid C16' | — | — | — | 0.5 | 0.5 |
| Oleic acid C18' | 1 | 1 | 1 | 0.5 | — |
| Linolic acid C18" | — | — | — | — | 0.5 |
| Erucic acid C22' | — | — | — | — | — |
| Total (1) + (2) + (3) | 100.0 | 100.0 | 100.0 | 100.0 | 100.0 |
| Penetration (×0.1 mm) | 278 | 274 | 275 | 271 | 272 |
| Dropping point (° C.) | 254 | 258 | 254 | 261 | 261 |
| Kinematic viscosity of base oil (40° C., $mm^2$/sec) | 66.80 | 59.53 | 47.08 | 101.1 | 101.1 |
| Friction tests (friction coefficient) | | | | | |
| (1) Polyamide resin-steel | 0.046 | 0.056 | 0.057 | 0.048 | 0.048 |
| (2) Polyacetal resin-copper alloy | — | — | — | 0.045 | — |

TABLE 3

| | Example | | | | |
|---|---|---|---|---|---|
| | 11 | 12 | 13 | 14 | 15 |
| (1) Base oil (mass %) | | | | | |
| Lubricating oil A | 88.0 | 85.0 | 89.5 | 89.5 | 89.5 |
| Lubricating oil B | — | — | — | — | — |
| Lubricating oil C | — | — | — | — | — |
| (2) Thickener (mass %) | | | | | |
| Thickener A | 10.0 | 10.0 | 10.0 | — | — |
| Thickener B | — | — | — | 8.5 | 8.5 |
| Thickener C | — | — | — | — | — |
| Thickener D | — | — | — | — | — |
| Thickener E | — | — | — | — | — |
| (3) Amount of fatty acid amine salt added (mass %) | 2.0 | 5.0 | 0.5 | 2.0 | 2.0 |
| Primary amine (molar ratio) | | | | | |
| Octylamine C8 | 0.5 | — | — | — | — |
| Laurylamine C12 | — | — | — | — | — |
| Myristylamine C14 | — | — | — | — | — |
| Stearylamine C18 | — | 1 | — | 1 | — |
| Behenylamine C22 | 0.5 | — | — | — | — |
| Oleylamine C18'-16' | — | — | 1 | — | 1 |
| 2-ethylhexylamine iso-C8 | — | — | — | — | — |
| Fatty acid (molar ratio) | | | | | |
| Caproic acid C6 | — | — | — | — | — |
| Caprylic acid C8 | — | — | — | — | — |
| Lauric acid C12 | — | — | — | — | — |
| Myristic acid C14 | — | — | — | — | — |
| Palmitic acid C16 | — | — | — | — | — |
| Stearic acid C18 | — | — | — | — | — |
| 12-Hydroxystearic acid C18 | — | — | — | — | — |
| Behenic acid C22 | — | — | — | — | — |
| 2-Ethylhexanoic acid iso-C8 | — | — | — | — | — |
| Palmitoylic acid C16' | — | — | — | — | — |
| Oleic acid C18' | — | — | — | 1 | 1 |
| Linolic acid C18" | — | — | — | — | — |
| Erucic acid C22' | | 1 | 1 | — | — |
| Total (1) + (2) + (3) | 100.0 | 100.0 | 100.0 | 100.0 | 100.0 |
| Penetration (×0.1 mm) | 273 | 269 | 271 | 273 | 268 |
| Dropping point (° C.) | 259 | 265 | 258 | 180 | 181 |
| Kinematic viscosity of base oil (40° C., $mm^2$/sec) | 101.1 | 101.1 | 101.1 | 101.1 | 101.1 |
| Friction tests (friction coefficient) | | | | | |
| (1) Polyamide resin-steel | 0.046 | 0.052 | 0.055 | 0.049 | 0.048 |
| (2) Polyacetal resin-copper alloy | 0.042 | 0.049 | 0.051 | 0.044 | — |

TABLE 4

| | Example | | | | |
|---|---|---|---|---|---|
| | 16 | 17 | 18 | 19 | 20 |
| (1) Base oil (mass %) | | | | | |
| Lubricating oil A | 71.5 | 71.5 | 86.0 | 76.5 | 78.0 |
| Lubricating oil B | — | — | — | — | — |
| Lubricating oil C | — | — | — | — | — |
| (2) Thickener (mass %) | | | | | |
| Thickener A | — | — | 6.0 | 7.0 | 8.5 |
| Thickener B | — | — | 6.0 | — | — |
| Thickener C | 26.5 | 26.5 | — | 14.5 | — |
| Thickener D | — | — | — | — | 11.5 |
| Thickener E | — | — | — | — | — |
| (3) Amount of fatty acid amine salt added (mass %) | 2.0 | 2.0 | 2.0 | 2.0 | 2.0 |
| Primary amine (molar ratio) | | | | | |
| Octylamine C8 | — | — | — | — | — |
| Laurylamine C12 | — | — | 1 | — | — |
| Myristylamine C14 | — | — | — | — | — |

TABLE 4-continued

| | Example | | | | |
|---|---|---|---|---|---|
| | 16 | 17 | 18 | 19 | 20 |
| Stearylamine C18 | 1 | — | — | — | — |
| Behenylamine C22 | — | 1 | — | — | — |
| Oleylamine C18'-16' | — | — | — | 1 | — |
| 2-ethylhexylamine iso-C8 | — | — | — | — | 1 |
| Fatty acid (molar ratio) | | | | | |
| Caproic acid C6 | — | — | — | — | — |
| Caprylic acid C8 | — | — | — | — | — |
| Lauric acid C12 | — | — | — | — | — |
| Myristic acid C14 | — | — | — | — | — |
| Palmitic acid C16 | — | — | — | — | — |
| Stearic acid C18 | — | — | — | — | — |
| 12-Hydroxystearic acid C18 | — | — | — | — | — |
| Behenic acid C22 | — | — | — | — | — |
| 2-Ethylhexanoic acid iso-C8 | — | — | — | — | — |
| Palmitoylic acid C16' | — | — | — | — | — |
| Oleic acid C18' | 1 | — | — | — | 1 |
| Linolic acid C18" | — | 1 | 1 | — | — |
| Erucic acid C22' | — | — | — | 1 | — |
| Total (1) + (2) + (3) | 100.0 | 100.0 | 100.0 | 100.0 | 100.0 |
| Penetration (×0.1 mm) | 300 | 303 | 272 | 284 | 277 |
| Dropping point (° C.) | 268 | 260 | 211 | 230 | 223 |
| Kinematic viscosity of base oil (40° C., $mm^2$/sec) | 101.1 | 101.1 | 101.1 | 101.1 | 101.1 |
| Friction tests (friction coefficient) | | | | | |
| (1) Polyamide resin-steel | 0.059 | 0.051 | 0.049 | 0.057 | 0.047 |
| (2) Polyacetal resin-copper alloy | — | 0.056 | — | 0.055 | 0.051 |

TABLE 5

| | Example | | | | |
|---|---|---|---|---|---|
| | 21 | 22 | 23 | 24 | 25 |
| (1) Base oil (mass %) | | | | | |
| Lubricating oil A | 83.0 | 81.0 | 71.0 | 75.0 | 83.0 |
| Lubricating oil B | — | — | — | — | — |
| Lubricating oil C | — | — | — | — | — |
| (2) Thickener (mass %) | | | | | |
| Thickener A | 7.5 | — | — | — | — |
| Thickener B | — | 7.0 | — | — | — |
| Thickener C | — | 10.0 | 15.5 | 13.5 | — |
| Thickener D | — | — | 11.5 | — | — |
| Thickener E | 7.5 | — | — | 9.5 | 15.0 |
| (3) Amount of fatty acid amine salt added (mass %) | 2.0 | 2.0 | 2.0 | 2.0 | 2.0 |
| Primary amine (molar ratio) | | | | | |
| Octylamine C8 | — | 0.5 | — | — | — |
| Laurylamine C12 | — | — | — | — | — |
| Myristylamine C14 | — | — | 0.5 | — | — |
| Stearylamine C18 | 1 | — | — | 1 | 1 |
| Behenylamine C22 | — | 0.5 | — | — | — |
| Oleylamine C18'-16' | — | — | 0.5 | — | — |
| 2-ethylhexylamine iso-C8 | — | — | — | — | — |
| Fatty acid (molar ratio) | | | | | |
| Caproic acid C6 | — | — | — | — | — |
| Caprylic acid C8 | — | — | — | — | — |
| Lauric acid C12 | — | — | — | — | — |
| Myristic acid C14 | — | — | — | — | — |
| Palmitic acid C16 | — | — | — | — | — |
| Stearic acid C18 | — | — | — | — | — |
| 12-Hydroxystearic acid C18 | — | — | — | — | — |
| Behenic acid C22 | — | — | — | — | — |
| 2-Ethylhexanoic acid iso-C8 | — | — | — | — | — |
| Palmitoylic acid C16' | — | — | — | 0.5 | — |

TABLE 5-continued

| | Example | | | | |
|---|---|---|---|---|---|
| | 21 | 22 | 23 | 24 | 25 |
| Oleic acid C18' | 1 | 0.5 | — | — | — |
| Linolic acid C18" | — | — | 1 | — | 0.5 |
| Erucic acid C22' | — | 0.5 | — | 0.5 | 0.5 |
| Total (1) + (2) + (3) | 100.0 | 100.0 | 100.0 | 100.0 | 100.0 |
| Penetration (×0.1 mm) | 281 | 288 | 307 | 295 | 285 |
| Dropping point (° C.) | >270 | 198 | 212 | 235 | >270 |
| Kinematic viscosity of base oil (40° C., $mm^2$/sec) | 101.1 | 101.1 | 101.1 | 101.1 | 101.1 |
| Friction tests (friction coefficient) | | | | | |
| (1) Polyamide resin-steel | 0.045 | 0.046 | 0.044 | 0.053 | 0.047 |
| (2) Polyacetal resin-copper alloy | — | — | 0.044 | — | — |

TABLE 6

| | Example | | | | | |
|---|---|---|---|---|---|---|
| | 26 | 27 | 28 | 29 | 30 | 31 |
| (1) Base oil (mass %) | | | | | | |
| Lubricating oil A | 88.0 | 88.0 | 89.0 | 44.5 | 44.0 | — |
| Lubricating oil B | — | — | — | 44.5 | 22.5 | 89.0 |
| Lubricating oil C | — | — | — | — | 22.5 | — |
| (2) Thickener (mass %) | | | | | | |
| Thickener A | 10.0 | 10.0 | 10.0 | 10.0 | 10.0 | 10.0 |
| Thickener B | — | — | — | — | — | — |
| Thickener C | — | — | — | — | — | — |
| Thickener D | — | — | — | — | — | — |
| Thickener E | — | — | — | — | — | — |
| (3) Amount of fatty acid amine salt added (mass %) | 2.0 | 2.0 | 1.0 | 1.0 | 1.0 | 1.0 |
| Primary amine (molar ratio) | | | | | | |
| Octylamine C8 | — | — | — | — | — | — |
| Laurylamine C12 | — | — | — | — | — | — |
| Myristylamine C14 | — | — | — | — | — | — |
| Stearylamine C18 | — | — | — | — | — | — |
| Behenylamine C22 | — | — | — | — | — | — |
| Oleylamine C18'-16' | 1 | 1 | 1 | 1 | 1 | 1 |
| 2-ethylhexylamine iso-C8 | — | — | — | — | — | — |
| Fatty acid (molar ratio) | | | | | | |
| Caproic acid C6 | 1 | — | — | — | — | — |
| Caprylic acid C8 | — | 1 | — | — | — | — |
| Lauric acid C12 | — | — | 1 | — | — | — |
| Myristic acid C14 | — | — | — | 1 | — | — |
| Palmitic acid C16 | — | — | — | — | 1 | — |
| Stearic acid C18 | — | — | — | — | — | 1 |
| 12-Hydroxystearic acid C18 | — | — | — | — | — | — |
| Behenic acid C22 | — | — | — | — | — | — |
| 2-Ethylhexanoic acid iso-C8 | — | — | — | — | — | — |
| Total (1) + (2) + (3) | 100.0 | 100.0 | 100.0 | 100.0 | 100.0 | 100.0 |
| Penetration (×0.1 mm) | 279 | 275 | 276 | 275 | 272 | 274 |
| Dropping point (° C.) | 260 | 262 | 258 | 263 | 266 | 262 |
| Kinematic viscosity of base oil (40° C., $mm^2$/sec) | 101.1 | 101.1 | 101.1 | 53.51 | 59.53 | 31.24 |
| Friction tests (friction coefficient) | | | | | | |
| (1) Polyamide resin-steel | 0.056 | 0.051 | 0.052 | 0.049 | 0.056 | 0.055 |
| (2) Polyacetal resin-copper alloy | 0.054 | — | — | 0.052 | — | 0.054 |

TABLE 7

| | Example | | | | | |
|---|---|---|---|---|---|---|
| | 32 | 33 | 34 | 35 | 36 | 37 |
| (1) Base oil (mass %) | | | | | | |
| Lubricating oil A | — | 89.5 | 89.5 | 86.5 | 89.5 | 89.5 |
| Lubricating oil B | — | — | — | — | — | — |
| Lubricating oil C | 89.0 | — | — | — | — | — |
| (2) Thickener (mass %) | | | | | | |
| Thickener A | 10.0 | 10.0 | — | — | — | — |
| Thickener B | — | — | 8.5 | 8.5 | 8.5 | 8.5 |
| Thickener C | — | — | — | — | — | — |
| Thickener D | — | — | — | — | — | — |
| Thickener E | — | — | — | — | — | — |
| (3) Amount of fatty acid amine salt added (mass %) | 1.0 | 0.5 | 2.0 | 5.0 | 2.0 | 2.0 |
| Primary amine (molar ratio) | | | | | | |
| Octylamine C8 | — | — | — | — | — | — |
| Laurylamine C12 | — | — | — | — | — | — |
| Myristylamine C14 | — | — | — | — | — | — |
| Stearylamine C18 | — | — | — | — | — | — |
| Behenylamine C22 | — | — | — | — | — | — |
| Oleylamine C18'-16' | 1 | 1 | 1 | 1 | 1 | 1 |
| 2-ethylhexylamine iso-C8 | — | — | — | — | — | — |
| Fatty acid (molar ratio) | | | | | | |
| Caproic acid C6 | — | — | 1 | — | — | — |
| Caprylic acid C8 | — | — | — | 1 | — | — |
| Lauric acid C12 | — | — | — | — | 1 | — |
| Myristic acid C14 | — | — | — | — | — | 1 |
| Palmitic acid C16 | — | — | — | — | — | — |
| Stearic acid C18 | — | — | — | — | — | — |
| 12-Hydroxystearic acid C18 | 1 | — | — | — | — | — |
| Behenic acid C22 | — | 1 | — | — | — | — |
| 2-Ethylhexanoic acid iso-C8 | — | — | — | — | — | — |
| Total (1) + (2) + (3) | 100.0 | 100.0 | 100.0 | 100.0 | 100.0 | 100.0 |
| Penetration (×0.1 mm) | 270 | 271 | 274 | 276 | 277 | 273 |
| Dropping point (° C.) | 263 | 260 | 178 | 179 | 178 | 180 |
| Kinematic viscosity of base oil (40° C., $mm^2$/sec) | 47.08 | 101.1 | 101.1 | 101.1 | 101.1 | 101.1 |
| Friction tests (friction coefficient) | | | | | | |
| (1) Polyamide resin-steel | 0.053 | 0.065 | 0.062 | 0.059 | 0.062 | 0.065 |
| (2) Polyacetal resin-copper alloy | — | 0.059 | — | 0.062 | 0.060 | — |

TABLE 8

| | Example | | | | | |
|---|---|---|---|---|---|---|
| | 38 | 39 | 40 | 41 | 42 | 43 |
| (1) Base oil (mass %) | | | | | | |
| Lubricating oil A | 71.5 | 71.5 | 86.0 | 76.5 | 78.0 | 78.0 |
| Lubricating oil B | — | — | — | — | — | — |
| Lubricating oil C | — | — | — | — | — | — |
| (2) Thickener (mass %) | | | | | | |
| Thickener A | — | — | 6.0 | 7.0 | 8.5 | 8.5 |
| Thickener B | — | — | 6.0 | — | — | — |
| Thickener C | 26.5 | 26.5 | — | 14.5 | — | — |
| Thickener D | — | — | — | — | 11.5 | 11.5 |
| Thickener E | — | — | — | — | — | — |
| (3) Amount of fatty acid amine salt added (mass %) | 2.0 | 2.0 | 2.0 | 2.0 | 2.0 | 2.0 |
| Primary amine (molar ratio) | | | | | | |
| Octylamine C8 | — | — | — | — | — | — |
| Laurylamine C12 | — | — | — | — | — | — |
| Myristylamine C14 | — | — | — | — | — | — |
| Stearylamine C18 | — | — | — | — | — | — |
| Behenylamine C22 | — | — | — | — | — | — |
| Oleylamine C18'-16' | 1 | 1 | 1 | 1 | 1 | 1 |
| 2-ethylhexylamine iso-C8 | — | — | — | — | — | — |

TABLE 8-continued

| | Example | | | | | |
|---|---|---|---|---|---|---|
| | 38 | 39 | 40 | 41 | 42 | 43 |
| Fatty acid (molar ratio) | | | | | | |
| Caproic acid C6 | — | — | — | — | — | — |
| Caprylic acid C8 | — | — | — | — | — | — |
| Lauric acid C12 | 1 | — | — | — | — | 0.5 |
| Myristic acid C14 | — | — | 1 | — | — | — |
| Palmitic acid C16 | — | — | — | — | 1 | — |
| Stearic acid C18 | — | 1 | — | 1 | — | — |
| 12-Hydroxystearic acid C18 | — | — | — | — | — | — |
| Behenic acid C22 | — | — | — | — | — | 0.5 |
| 2-Ethylhexanoic acid iso-C8 | — | — | — | — | — | — |
| Total (1) + (2) + (3) | 100.0 | 100.0 | 100.0 | 100.0 | 100.0 | 100.0 |
| Penetration (×0.1 mm) | 305 | 299 | 274 | 289 | 282 | 278 |
| Dropping point (° C.) | 258 | >270 | 209 | 244 | 218 | 222 |
| Kinematic viscosity of base oil (40° C., $mm^2$/sec) | 101.1 | 101.1 | 101.1 | 101.1 | 101.1 | 101.1 |
| Friction tests (friction coefficient) | | | | | | |
| (1) Polyamide resin-steel | 0.057 | 0.059 | 0.056 | 0.052 | 0.049 | 0.055 |
| (2) Polyacetal resin-copper alloy | — | 0.061 | 0.055 | 0.054 | — | 0.062 |

TABLE 9

| | Example | | | | |
|---|---|---|---|---|---|
| | 44 | 45 | 46 | 47 | 48 |
| (1) Base oil (mass %) | | | | | |
| Lubricating oil A | 83.0 | 81.0 | 71.0 | 75.0 | 83.0 |
| Lubricating oil B | — | — | — | — | — |
| Lubricating oil C | — | — | — | — | — |
| (2) Thickener (mass %) | | | | | |
| Thickener A | 7.5 | — | — | — | — |
| Thickener B | — | 7.0 | — | — | — |
| Thickener C | — | 10.0 | 15.5 | 13.5 | — |
| Thickener D | — | — | 11.5 | — | — |
| Thickener E | 7.5 | — | — | 9.5 | 15.0 |
| (3) Amount of fatty acid amine salt added (mass %) | 2.0 | 2.0 | 2.0 | 2.0 | 2.0 |
| Primary amine (molar ratio) | | | | | |
| Octylamine C8 | — | — | — | — | — |
| Laurylamine C12 | — | — | — | — | — |
| Myristylamine C14 | — | — | — | — | — |
| Stearylamine C18 | — | — | — | — | — |
| Behenylamine C22 | — | — | — | — | — |
| Oleylamine C18'-16' | 1 | 1 | 1 | 1 | 1 |
| 2-ethylhexylamine iso-C8 | — | — | — | — | — |
| Fatty acid (molar ratio) | | | | | |
| Caproic acid C6 | — | 1 | — | 0.5 | — |
| Caprylic acid C8 | — | — | — | — | — |
| Lauric acid C12 | — | — | 0.5 | — | — |
| Myristic acid C14 | 0.5 | — | — | — | — |
| Palmitic acid C16 | — | — | — | — | — |
| Stearic acid C18 | — | — | 0.5 | 0.5 | — |
| 12-Hydroxystearic acid C18 | — | — | — | — | 1 |
| Behenic acid C22 | 0.5 | — | — | — | — |
| 2-Ethylhexanoic-acid iso-C8 | — | — | — | — | — |
| Total (1) + (2) + (3) | 100.0 | 100.0 | 100.0 | 100.0 | 100.0 |
| Penetration (×0.1 mm) | 289 | 296 | 301 | 296 | 287 |
| Dropping point (° C.) | >270 | 192 | 221 | 239 | >270 |
| Kinematic viscosity of base oil (40° C., $mm^2$/sec) | 101.1 | 101.1 | 101.1 | 101.1 | 101.1 |
| Friction tests (friction coefficient) | | | | | |
| (1) Polyamide resin-steel | 0.049 | 0.060 | 0.054 | 0.055 | 0.048 |
| (2) Polyacetal resin-copper alloy | 0.054 | 0.049 | 0.55 | 0.052 | — |

TABLE 10

| | Comparative Example | | | | | |
|---|---|---|---|---|---|---|
| | 1 | 2 | 3 | 4 | 5 | 6 |
| (1) Base oil (mass %) | | | | | | |
| Lubricating oil A | 90.0 | 91.5 | 80.0 | 82.0 | 85.0 | 88.0 |
| Lubricating oil B | — | — | — | — | — | — |
| Lubricating oil C | — | — | — | — | — | — |
| (2) Thickener (mass %) | | | | | | |
| Thickener A | 10.0 | — | 5.0 | — | 7.5 | 10.0 |
| Thickener B | — | 8.5 | — | — | — | — |
| Thickener C | — | — | 15.0 | 10.5 | — | — |
| Thickener D | — | — | — | 7.5 | — | — |
| Thickener E | — | — | — | — | 7.5 | — |
| (3) Amount of fatty acid amine salt or fatty acid added (mass %) | — | — | — | — | — | 2.0 |
| Primary amine (molar ratio) | | | | | | |
| Octylamine C8 | — | — | — | — | — | — |
| Laurylamine C12 | — | — | — | — | — | — |
| Myristylamine C14 | — | — | — | — | — | — |
| Stearylamine C18 | — | — | — | — | — | — |
| Behenylamine C22 | — | — | — | — | — | — |
| Oleylamine C18'-16' | — | — | — | — | — | — |
| 2-ethylhexylamine iso-C8 | — | — | — | — | — | — |
| Fatty acid (molar ratio) | | | | | | |
| Caproic acid C6 | — | — | — | — | — | — |
| Caprylic acid C8 | — | — | — | — | — | — |
| Lauric acid C12 | — | — | — | — | — | — |
| Myristic acid C14 | — | — | — | — | — | — |
| Palmitic acid C16 | — | — | — | — | — | — |
| Stearic acid C18 | — | — | — | — | — | — |
| 12-Hydroxystearic acid C18 | — | — | — | — | — | — |
| Behenic acid C22 | — | — | — | — | — | — |
| 2-Ethylhexanoic acid iso-C8 | — | — | — | — | — | 1 |
| Palmitoylic acid C16' | — | — | — | — | — | — |
| Oleic acid C18' | — | — | — | — | — | — |
| Linolic acid C18" | — | — | — | — | — | — |
| Erucic acid C22' | — | — | — | — | — | — |
| Total (1) + (2) + (3) | 100.0 | 100.0 | 100.0 | 100.0 | 100.0 | 100.0 |
| Penetration (×0.1 mm) | 269 | 273 | 288 | 278 | 266 | 270 |
| Dropping point (° C.) | 267 | 182 | >270 | >270 | >270 | 266 |
| Kinematic viscosity of base oil (40° C., $mm^2$/sec) | 101.1 | 101.1 | 101.1 | 101.1 | 101.1 | 101.1 |
| Friction tests (friction coefficient) | | | | | | |
| (1) Polyamide resin-steel | 0.118 | 0.082 | 0.105 | 0.115 | 0.109 | 0.111 |
| (2) Polyacetal resin-copper alloy | 0.121 | 0.101 | — | 0.102 | — | 0.096 |

TABLE 11

| | Comparative Example | | | | | |
|---|---|---|---|---|---|---|
| | 7 | 8 | 9 | 10 | 11 | 12 |
| (1) Base oil (mass %) | | | | | | |
| Lubricating oil A | 44.0 | 44.75 | 44.0 | 89.5 | 89.5 | 89.5 |
| Lubricating oil B | 44.0 | — | 22.75 | — | — | — |
| Lubricating oil C | — | 44.75 | 22.75 | — | — | — |
| (2) Thickener (mass %) | | | | | | |
| Thickener A | 10.0 | — | — | — | — | — |
| Thickener B | — | 8.5 | 8.5 | 8.5 | 8.5 | 8.5 |
| Thickener C | — | — | — | — | — | — |
| Thickener D | — | — | — | — | — | — |
| Thickener E | — | — | — | — | — | — |
| (3) Amount of primary amine or fatty acid amine salt added (mass %) | 2.0 | 2.0 | 2.0 | 2.0 | 2.0 | 2.0 |
| Primary amine (molar ratio) | | | | | | |
| Octylamine C8 | — | 1 | — | 1 | — | — |
| Laurylamine C12 | — | — | 1 | — | — | — |

TABLE 11-continued

| | Comparative Example | | | | | |
|---|---|---|---|---|---|---|
| | 7 | 8 | 9 | 10 | 11 | 12 |
| Myristylamine C14 | — | — | — | — | — | — |
| Stearylamine C18 | 1 | — | — | — | — | — |
| Behenylamine C22 | — | — | — | — | 1 | — |
| Oleylamine C18'-16' | — | — | — | — | — | — |
| 2-ethylhexylamine iso-C8 | — | — | — | — | — | 1 |
| Fatty acid (molar ratio) | | | | | | |
| Caproic acid C6 | — | 1 | 1 | — | — | — |
| Caprylic acid C8 | — | — | — | — | — | — |
| Lauric acid C12 | — | — | — | 1 | — | — |
| Myristic acid C14 | — | — | — | — | 1 | — |
| Palmitic acid C16 | — | — | — | — | — | 1 |
| Stearic acid C18 | — | — | — | — | — | — |
| 12-Hydroxystearic acid C18 | — | — | — | — | — | — |
| Behenic acid C22 | — | — | — | — | — | — |
| 2-Ethylhexanoic acid iso-C8 | — | — | — | — | — | — |
| Palmitoylic acid C16' | — | — | — | — | — | — |
| Oleic acid C18' | — | — | — | — | — | — |
| Linolic acid C18" | — | — | — | — | — | — |
| Erucic acid C22' | — | — | — | — | — | — |
| Total (1) + (2) + (3) | 100.0 | 100.0 | 100.0 | 100.0 | 100.0 | 100.0 |
| Penetration (×0.1 mm) | 273 | 271 | 277 | 271 | 272 | 270 |
| Dropping point (° C.) | 265 | 177 | 178 | 178 | 175 | 176 |
| Kinematic viscosity of base oil (40° C., $mm^2$/sec) | 53.51 | 66.80 | 59.51 | 101.1 | 101.1 | 101.1 |
| Friction tests (friction coefficient) | | | | | | |
| (1) Polyamide resin-steel | 0.091 | 0.094 | 0.087 | 0.082 | 0.088 | 0.081 |
| (2) Polyacetal resin-copper alloy | — | — | 0.088 | 0.093 | 0.092 | — |

TABLE 12

| | Comparative Example | | | | | |
|---|---|---|---|---|---|---|
| | 13 | 14 | 15 | 16 | 17 | 18 |
| (1) Base oil (mass %) | | | | | | |
| Lubricating oil A | 71.5 | 76.5 | 71.0 | 88.0 | 81.0 | 80.0 |
| Lubricating oil B | — | — | — | — | — | — |
| Lubricating oil C | — | — | — | — | — | — |
| (2) Thickener (mass %) | | | | | | |
| Thickener A | — | 7.0 | — | 10.0 | — | 7.5 |
| Thickener B | — | — | — | — | 7.0 | — |
| Thickener C | 26.5 | 14.5 | 15.5 | — | 10.0 | — |
| Thickener D | — | — | 11.5 | — | — | — |
| Thickener E | — | — | — | — | — | 7.5 |
| (3) Amount of fatty acid amine salt added (mass %) | 2.0 | 2.0 | 2.0 | 2.0 | 2.0 | 5.0 |
| Primary amine (molar ratio) | | | | | | |
| Octylamine C8 | — | — | — | — | — | — |
| Laurylamine C12 | — | — | — | — | 1 | — |
| Myristylamine C14 | — | — | — | 0.5 | — | — |
| Stearylamine C18 | 1 | — | 1 | 0.5 | — | — |
| Behenylamine C22 | — | 1 | — | — | — | — |
| Oleylamine C18'-16' | — | — | — | — | — | — |
| 2-ethylhexylamine iso-C8 | — | — | — | — | — | 1 |
| Fatty acid (molar ratio) | | | | | | |
| Caproic acid C6 | — | — | — | — | — | — |
| Caprylic acid C8 | — | — | — | — | 0.5 | — |
| Lauric acid C12 | — | — | — | — | — | — |
| Myristic acid C14 | — | — | — | — | — | — |
| Palmitic acid C16 | — | — | — | — | — | — |
| Stearic acid C18 | 1 | 1 | — | — | — | — |
| 12-Hydroxystearic acid C18 | — | — | 1 | — | — | — |
| Behenic acid C22 | — | — | — | 1 | — | 1 |
| 2-Ethylhexanoic acid iso-C8 | — | — | — | — | 0.5 | — |
| Palmitoylic acid C16' | — | — | — | — | — | — |
| Oleic acid C18' | — | — | — | — | — | — |

TABLE 12-continued

| | Comparative Example | | | | | |
|---|---|---|---|---|---|---|
| | 13 | 14 | 15 | 16 | 17 | 18 |
| Linolic acid C18" | — | — | — | — | — | — |
| Erucic acid C22' | — | — | — | — | — | — |
| Total (1) + (2) + (3) | 100.0 | 100.0 | 100.0 | 100.0 | 100.0 | 100.0 |
| Penetration (×0.1 mm) | 302 | 280 | 301 | 275 | 294 | 292 |
| Dropping point (° C.) | 255 | 233 | 216 | 265 | 198 | 266 |
| Kinematic viscosity of base oil (40° C., $mm^2$/sec) | 101.1 | 101.1 | 101.1 | 101.1 | 101.1 | 101.1 |
| Friction tests (friction coefficient) | | | | | | |
| (1) Polyamide resin-steel | 0.119 | 0.097 | 0.127 | 0.082 | 0.098 | 0.101 |
| (2) Polyacetal resin-copper alloy | 0.105 | — | — | 0.088 | — | — |

That which is claimed is:

1. A grease composition comprising:

a base oil;

a thickener; and an unsaturated or saturated fatty acid amine salt having the general formula (1):

$$RCOO^- R'NH_3^+ \quad (1)$$

wherein either (i) R is an unsaturated hydrocarbon group having from 15 to 21 carbon atoms, and R' is a saturated or unsaturated linear or branched hydrocarbon group having from 8 to 22 carbon atoms;

or (ii) R is a linear saturated hydrocarbon group having from 5 to 21 carbon atoms, and R' is an unsaturated hydrocarbon group having from 16 to 18 carbon atoms;

wherein the total amount of the unsaturated or saturated fatty acid amine salt is in the range of from 1 to 5% by mass relative to the total amount of the grease composition.

2. A grease composition according to claim 1, wherein the base oil is selected from mineral oils, synthetic oils, animal and plant oils, and mixtures thereof.

3. A grease composition according to claim 2, wherein the thickener is selected from the group consisting of lithium salts, lithium 12 hydroxy soaps, calcium soaps, sodium soaps, barium soaps, barium complex soaps, calcium complex soaps, aluminium complex soaps, lithium complex soaps, bentone, clay, silica, tricalcium phosphate, calcium sulphonate complexes, polyureas, sodium terephthalamate, and mixtures thereof.

4. A grease composition according to claim 3, wherein the unsaturated fatty acid is selected from the group consisting of palmitoylic acid, oleic acid, vaccenic acid, linolic acid, linolenic acid, elaeostearic acid, eicosadienic acid, eicosatrienic acid, arichidonic acid and erucic acid.

5. A grease composition according to claim 3, wherein the saturated fatty acid is selected from the group consisting of caproic acid, caprylic acid, pelargonic acid, capric acid, lauric acid, linderic acid, myristic acid, tsuzuic acid, physetoleic acid, myristoleic acid, pentadecylic acid, palmitic acid, margaric acid, stearic acid, petroselinic acid, elaidic acid, tuberculostearic acid, arachidinic acid and behenic acid.

6. A grease composition according to claim 5, further comprising an additive selected from the group consisting of anti-oxidants, rust inhibitors, oiliness agents, extreme pressure agents, anti-wear agents, solid lubricants, metal deactivators, polymers and mixtures thereof.

* * * * *